US010811023B2

(12) United States Patent
Kjoerling et al.

(10) Patent No.: US 10,811,023 B2
(45) **Date of Patent: *Oct. 20, 2020**

(54) TIME-ALIGNMENT OF QMF BASED PROCESSING DATA

(71) Applicant: DOLBY INTERNATIONAL AB, Amsterdam Zuidoost (NL)

(72) Inventors: Kristofer Kjoerling, Solna (SE); Heiko Purnhagen, Sundbyberg (SE); Jens Popp, Nuremberg (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/720,482

(22) Filed: Sep. 29, 2017

(65) Prior Publication Data

US 2018/0025739 A1 Jan. 25, 2018

Related U.S. Application Data

(62) Division of application No. 15/021,820, filed as application No. PCT/EP2014/069039 on Sep. 8, 2014, now Pat. No. 10,510,355.

(Continued)

(51) Int. Cl.
*G10L 19/16* (2013.01)
*G10L 19/018* (2013.01)

(Continued)

(52) U.S. Cl.
CPC ..... *G10L 19/167* (2013.01); *G10L 19/018* (2013.01); *G10L 19/0204* (2013.01); *G10L 19/032* (2013.01); *G10L 21/0388* (2013.01)

(58) Field of Classification Search
CPC ..... G10L 19/16

(Continued)

(56) References Cited

U.S. PATENT DOCUMENTS 5,023,913 A 6/1991 Matsumoto
5,500,900 A 3/1996 Chen (Continued)

FOREIGN PATENT DOCUMENTS

CA 2840788 2/2013
CN 102280109 12/2011

(Continued)

OTHER PUBLICATIONS

Den Brinker, A.C. et al "An Overview of the Coding Standard MPEG-4 Audio Amendments 1 and 2: HE-AAC, SSC, and HE-AAC v2" Hindawi Publishing Corporation, EURASIP Journal on Audio, Speech, and Music Processing, vol. 2009, 21 pages, published in Jan. 2009.

(Continued)

*Primary Examiner* — Bhavesh M Mehta
*Assistant Examiner* — Timothy Nguyen

(57) ABSTRACT

The present document relates to time-alignment of encoded data of an audio encoder with associated metadata, such as spectral band replication (SBR) metadata. An audio decoder configured to determine a reconstructed frame of an audio signal from an access unit of a received data stream is described. The access unit comprises waveform data and metadata, wherein the waveform data and the metadata are associated with the same reconstructed frame of the audio signal. The audio decoder comprises a waveform processing path configured to generate a plurality of waveform subband signals from the waveform data, and a metadata processing path configured to generate decoded metadata from the metadata.

9 Claims, 6 Drawing Sheets

Related U.S. Application Data

Figure 1:
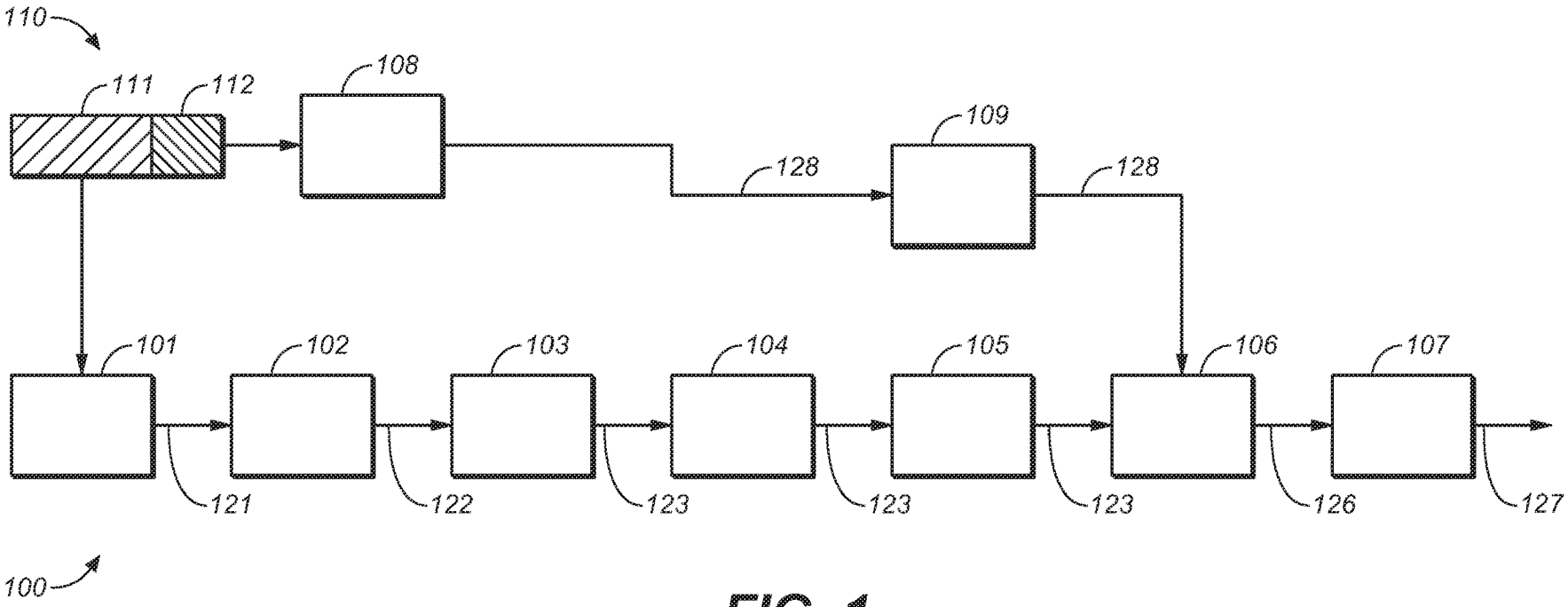

(60) Provisional application No. 61/877,194, filed on Sep. 12, 2013, provisional application No. 61/909,593, filed on Nov. 27, 2013.

(51) Int. Cl.
*G10L 19/02* (2013.01)
*G10L 21/0388* (2013.01)
*G10L 19/032* (2013.01)

(58) Field of Classification Search
USPC ..... 704/500
See application file for complete search history.

(56) References Cited

U.S. PATENT DOCUMENTS

| | | | | |
|---|---|---|---|---|
| 6,226,616 | B1 * | 5/2001 | You | G10L 19/008 704/500 |
| 6,240,386 | B1 | 5/2001 | Thyssen | |
| 6,243,476 | B1 | 6/2001 | Gardner | |
| 6,903,664 | B2 * | 6/2005 | Schroder | G10L 19/167 341/50 |
| 7,412,376 | B2 * | 8/2008 | Florencio | G10L 25/87 370/470 |
| 8,095,357 | B2 | 1/2012 | Pang | |
| 8,311,809 | B2 | 11/2012 | Schuijers | |
| 8,355,911 | B2 | 1/2013 | Zhan | |
| 8,452,605 | B2 | 5/2013 | Schnell | |
| 8,489,391 | B2 | 7/2013 | Kurniawati | |
| 9,640,185 | B2 | 5/2017 | Kushner | |
| 2003/0167165 | A1 * | 9/2003 | Schroder | G10L 19/167 704/212 |
| 2004/0176051 | A1 * | 9/2004 | Papadimitriou | H04B 1/71075 455/101 |
| 2005/0055201 | A1 * | 3/2005 | Florencio | G10L 25/87 704/214 |
| 2007/0165869 | A1 | 7/2007 | Ojanpera | |
| 2008/0133242 | A1 * | 6/2008 | Sung | G10L 19/005 704/262 |
| 2009/0240507 | A1 | 9/2009 | Jax | |
| 2010/0063805 | A1 | 3/2010 | Bruhn | |
| 2010/0083344 | A1 | 4/2010 | Schildbach | |
| 2010/0094642 | A1 * | 4/2010 | Zhan | G10L 19/005 704/500 |
| 2011/0054911 | A1 * | 3/2011 | Baumgarte | G10L 19/24 704/500 |
| 2012/0136670 | A1 | 5/2012 | Ishikawa | |
| 2013/0030817 | A1 | 1/2013 | Purnhagen | |
| 2013/0030819 | A1 | 1/2013 | Purnhagen | |
| 2013/0121411 | A1 | 5/2013 | Robillard | |
| 2013/0332151 | A1 * | 12/2013 | Fuchs | G10L 19/012 704/207 |
| 2014/0074489 | A1 * | 3/2014 | Chong | G10L 19/20 704/500 |
| 2016/0225382 | A1 * | 8/2016 | Kjoerling | G10L 21/0388 |

FOREIGN PATENT DOCUMENTS

| | | |
|---|---|---|
| CN | 102610231 | 7/2012 |
| CN | 102667920 | 9/2012 |
| CN | 103155031 | 6/2013 |
| JP | 2004514180 | 5/2004 |
| JP | 2007-108219 | 4/2007 |
| JP | 2010507820 | 3/2010 |
| JP | 2010-520505 | 6/2010 |
| JP | 2013-501246 | 1/2013 |
| JP | 2013-084018 | 5/2013 |
| RU | 2406166 | 12/2010 |
| WO | 2012/126893 | 9/2012 |
| WO | 2012/146757 | 11/2012 |
| WO | 2012/158333 | 11/2012 |
| WO | 2012/163144 | 12/2012 |
| WO | 2014/161995 | 10/2014 |

OTHER PUBLICATIONS

Schnell, M. et al "Low Delay Filterbanks for Enhanced Low Delay Audio Coding" IEEE Workshop on Applications of Signal Processing to Audio and Acoustics, Oct. 21-24, 2007, pp. 235-238.

* cited by examiner

TIME-ALIGNMENT OF QMF BASED PROCESSING DATA

TECHNICAL FIELD OF THE INVENTION

The present document relates to time-alignment of encoded data of an audio encoder with associated metadata, such as spectral band replication (SBR), in particular High Efficiency (HE) Advanced Audio Coding (AAC), metadata.

BACKGROUND OF THE INVENTION

A technical problem in the context of audio coding is to provide audio encoding and decoding systems which exhibit a low delay, e.g. in order to allow for real-time applications such as live broadcasting. Furthermore, it is desirable to provide audio encoding and decoding systems that exchange encoded bitstreams which can be spliced with other bitstreams. In addition, computationally efficient audio encoding and decoding systems should be provided to allow for a cost efficient implementation of the systems. The present document addresses the technical problem of providing encoded bitstreams which can be spliced in an efficient manner, while at the same time maintaining latency at an appropriate level for live broadcasting. The present document describes an audio encoding and decoding system which allows for the splicing of bitstreams at reasonable coding delays, thereby enabling applications such as live broadcasting, where a broadcasted bitstream may be generated from a plurality of source bitstreams.

SUMMARY OF THE INVENTION

According to an aspect an audio decoder configured to determine a reconstructed frame of an audio signal from an access unit of a received data stream is described. Typically, the data stream comprises a sequence of access unit for determining a respective sequence of reconstructed frames of the audio signal. A frame of the audio signal typically comprises a pre-determined number N of time-domain samples of the audio signal (with N being greater than one). As such the sequence of access units may describe the sequence of frames of the audio signal, respectively.

The access unit comprises waveform data and metadata, wherein the waveform data and the metadata are associated with the same reconstructed frame of the audio signal. In other words, the waveform data and the metadata for determining the reconstructed frame of the audio signal are comprised within the same access unit. The access units of the sequence of access units may each comprise the waveform data and the metadata for generating a respective reconstructed frame of the sequence of reconstructed frames of the audio signal. In particular, the access unit of a particular frame may comprise (e.g. all) the data necessary for determining the reconstructed frame for the particular frame.

In an example, the access unit of a particular frame may comprise (e.g. all) the data necessary for performing an high frequency reconstruction (HFR) scheme for generating a highband signal of the particular frame based on a lowband signal of the particular frame (comprised within the waveform data of the access unit) and based on the decoded metadata.

Alternatively or in addition, the access unit of a particular frame may comprise (e.g. all) the data necessary for performing an expansion of the dynamic range of a particular frame. In particular, an expansion or an expanding of the lowband signal of the particular frame may be performed based on the decoded metadata. For this purpose, the decoded metadata may comprise one or more expanding parameters. The one or more expanding parameters may be indicative of one or more of: whether or not compression/expansion is to be applied to the particular frame; whether compression/expansion is to be applied in a homogeneous manner for all the channels of a multi-channel audio signal (i.e. whether the same expanding gain(s) are to be applied for all the channels of a multi-channel audio signal or whether different expanding gain(s) are to be applied for the different channels of the multi-channel audio signal); and/or a temporal resolution of an expanding gain.

The provision of a sequence of access units with access units each comprising the data necessary for generating a corresponding reconstructed frame of the audio signal, independent from a preceding or a succeeding access unit, is beneficial for splicing applications, as it allows the data stream to be spliced between two adjacent access units, without impacting the perceptual quality of a reconstructed frame of the audio signal at the (e.g. directly subsequent to the) splicing point.

In an example, the reconstructed frame of the audio signal comprises a lowband signal and a highband signal, wherein the waveform data is indicative of the lowband signal and wherein the metadata is indicative of a spectral envelope of the highband signal. The lowband signal may correspond to a component of the audio signal covering a relatively low frequency range (e.g. comprising frequencies smaller than a pre-determined cross over frequency). The highband signal may correspond to a component of the audio signal covering a relatively high frequency range (e.g. comprising frequencies higher than the pre-determined cross over frequency). The lowband signal and the highband signal may be complementary with regards to the frequency range covered by the lowband signal and by the highband signal. The audio decoder may be configured to perform high frequency reconstruction (HFR) such as spectral band replication (SBR) of the highband signal using the metadata and the waveform data. As such, the metadata may comprise HFR or SBR metadata indicative of the spectral envelope of the highband signal.

The audio decoder may comprise a waveform processing path configured to generate a plurality of waveform subband signals from the waveform data. The plurality of waveform subband signals may correspond to a representation of a time domain waveform signal in a subband domain (e.g. in a QMF domain). The time domain waveform signal may correspond to the above mentioned lowband signal, and the plurality of waveform subband signals may correspond to a plurality of lowband subband signals. Furthermore, the audio decoder may comprise a metadata processing path configured to generate decoded metadata from the metadata.

In addition, the audio decoder may comprise a metadata application and synthesis unit configured to generate the reconstructed frame of the audio signal from the plurality of waveform subband signals and from the decoded metadata. In particular, the metadata application and synthesis unit may be configured to perform an HFR and/or SBR scheme for generating a plurality of (e.g., scaled) highband subband signals from the plurality of waveform subband signals (i.e., in that case, from the plurality of lowband subband signals) and from the decoded metadata. The reconstructed frame of the audio signal may then be determined based on the plurality of (e.g. scaled) highband subband signals and based on the plurality of lowband signals.

Alternatively or in addition, the audio decoder may comprise an expanding unit configured to perform an expansion of or configured to expand the plurality of waveform subband signals using at least some of the decoded metadata, in particular using the one or more expanding parameters comprised within the decoded metadata. For this purpose, the expanding unit may be configured to apply one or more expanding gains to the plurality of waveform subband signals. The expanding unit may be configured to determine the one or more expanding gains based on the plurality of waveform subband signals, based on one or more predetermined compression/expanding rules or functions and/or based on the one or more expanding parameters.

The waveform processing path and/or the metadata processing path may comprise at least one delay unit configured to time-align the plurality of waveform subband signals and the decoded metadata. In particular, the at least one delay unit may be configured to align the plurality of waveform subband signals and the decoded metadata, and/or to insert at least one delay into the waveform processing path and/or into the metadata processing path, such that an overall delay of the waveform processing path corresponds to an overall delay of metadata processing path. Alternatively or in addition, the at least one delay unit may be configured to time-align the plurality of waveform subband signals and the decoded metadata such that the plurality of waveform subband signals and the decoded metadata are provided to the metadata application and synthesis unit just-in-time for the processing performed by the metadata application and synthesis unit. In particular, the plurality of waveform subband signals and the decoded metadata may be provided to the metadata application and synthesis unit such that the metadata application and synthesis unit does not need to buffer the plurality of waveform subband signals and/or the decoded metadata prior to performing processing (e.g. HFR or SBR processing) on the plurality of waveform subband signals and/or on the decoded metadata.

In other words, the audio decoder may be configured to delay the provisioning of the decoded metadata and/or of the plurality of waveform subband signals to the metadata application and synthesis unit, which may be configured to perform an HFR scheme, such that the decoded metadata and/or the plurality of waveform subband signals is provided as needed for processing. The inserted delay may be selected to reduce (e.g. to minimize) the overall delay of the audio codec (comprising the audio decoder and a corresponding audio encoder), while at the same time enabling splicing of a bitstream comprising the sequence of access units. As such, the audio decoder may be configured to handle time-aligned access units, which comprise the waveform data and the metadata for determining a particular reconstructed frame of the audio signal, with minimal impact on the overall delay of the audio codec. Furthermore, the audio decoder may be configured to handle time-aligned access units without the need for re-sampling metadata. By doing this, the audio decoder is configured to determine a particular reconstructed frame of the audio signal in a computationally efficient manner and without deteriorating the audio quality. Hence, the audio decoder may be configured to allow for splicing applications in a computationally efficient manner, while maintaining high audio quality and low overall delay.

Furthermore, the use of at least one delay unit configured to time-align the plurality of waveform subband signals and the decoded metadata may ensure a precise and consistent alignment of the plurality of waveform subband signals and of the decoded metadata in the subband domain (where the processing of the plurality of waveform subband signals and of the decoded metadata is typically performed).

The metadata processing path may comprise a metadata delay unit configured to delay the decoded metadata by an integer multiple greater than zero of the frame length N of the reconstructed frame of the audio signal. The additional delay which is introduced by the metadata delay unit may be referred to as the metadata delay. The frame length N may correspond to the number N of time domain samples comprised within the reconstructed frame of the audio signal. The integer multiple may be such that the delay introduced by the metadata delay unit is greater than a delay introduced by the processing of the waveform processing path (e.g. without considering an additional waveform delay introduced into the waveform processing path). The metadata delay may depend on the frame length N of the reconstructed frame of the audio signal. This may be due to the fact that the delay caused by the processing within the waveform processing path depends on the frame length N. In particular, the integer multiple may be one for frame lengths N greater than 960 and/or the integer multiple may be two for frame lengths N smaller than or equal to 960.

As indicated above, the metadata application and synthesis unit may be configured to process the decoded metadata and the plurality of waveform subband signals in the subband domain (e.g. in the QMF domain). Furthermore, the decoded metadata may be indicative of metadata (e.g. indicative of spectral coefficients describing the spectral envelope of the highband signal) in the subband domain. In addition, the metadata delay unit may be configured to delay the decoded metadata. The use of metadata delays which are integer multiples greater zero of the frame length N may be beneficial, as this ensures a consistent alignment of the plurality of waveform subband signals and of the decoded metadata in the subband domain (e.g. for processing within the metadata application and synthesis unit). In particular, this ensures that the decoded metadata can be applied to the correct frame of the waveform signal (i.e. to the correct frame of the plurality of waveform subband signals), without the need for resampling the metadata.

The waveform processing path may comprise a waveform delay unit configured to delay the plurality of waveform subband signals such that an overall delay of the waveform processing path corresponds to an integer multiple greater than zero of the frame length N of the reconstructed frame of the audio signal. The additional delay which is introduced by the waveform delay unit may be referred to as the waveform delay. The integer multiple of the waveform processing path may correspond to the integer multiple of the metadata processing path.

The waveform delay unit and/or the metadata delay unit may be implemented as buffers which are configured to store the plurality of waveform subband signals and/or the decoded metadata for an amount of time corresponding to the waveform delay and/or for an amount of time corresponding to the metadata delay. The waveform delay unit may be placed at any position within the waveform processing path upstream of the metadata application and synthesis unit. As such, the waveform delay unit may be configured to delay the waveform data and/or the plurality of waveform subband signals (and/or any intermediate data or signals within the waveform processing path). In an example, the waveform delay unit may be distributed along the waveform processing path, wherein the distributed delay units each provide a fraction of the total waveform delay. The distribution of the waveform delay unit may be beneficial for a cost efficient implementation of the waveform delay unit. In a similar manner to the waveform delay unit, the metadata delay unit may be placed at any position within the metadata processing path upstream of the metadata application and synthesis unit. Furthermore, the waveform delay unit may be distributed along the metadata processing path.

The waveform processing path may comprise a decoding and de-quantization unit configured to decode and de-quantize the waveform data to provide a plurality of frequency coefficients indicative of the waveform signal. As such, the waveform data may comprise or may be indicative of the plurality of frequency coefficients, which allows the generation of the waveform signal of the reconstructed frame of the audio signal. Furthermore, the waveform processing path may comprise a waveform synthesis unit configured to generate the waveform signal from the plurality of frequency coefficients. The waveform synthesis unit may be configured to perform a frequency domain to time domain transform. In particular, the waveform synthesis unit may be configured to perform an inverse modified discrete cosine transform (MDCT). The waveform synthesis unit or the processing of the waveform synthesis unit may introduce a delay which depends on the frame length N of the reconstructed frame of the audio signal. In particular, the delay introduced by the waveform synthesis unit may correspond to half the frame length N.

Subsequent to reconstructing the waveform signal from the waveform data, the waveform signal may be processed in conjunction with the decoded metadata. In an example, the waveform signal may be used in the context of an HFR or SBR scheme for determining the highband signal, using the decoded metadata. For this purpose, the waveform processing path may comprise an analysis unit configured to generate the plurality of waveform subband signals from the waveform signal. The analysis unit may be configured to perform a time domain to subband domain transform, e.g. by applying a quadrature mirror filter (QMF) bank. Typically, a frequency resolution of the transform performed by the waveform synthesis unit is higher (e.g. by a factor of at least 5 or 10) than a frequency resolution of the transform performed by the analysis unit. This may be indicated by the terms "frequency domain" and "subband domain", wherein the frequency domain may be associated with a higher frequency resolution than the subband domain. The analysis unit may introduce a fixed delay which is independent of the frame length N of the reconstructed frame of the audio signal. The fixed delay which is introduced by the analysis unit may be dependent on the length of the filters of a filter bank used by the analysis unit. By way of example, the fixed delay which is introduced by the analysis unit may correspond to 320 samples of the audio signal.

The overall delay of the waveform processing path may further depend on a pre-determined lookahead between metadata and waveform data. Such a lookahead may be beneficial for increasing continuity between adjacent reconstructed frames of the audio signal. The pre-determined lookahead and/or the associated lookahead delay may correspond to 192 or 384 samples of the audio sample. The lookahead delay may be a lookahead in the context of the determination of HFR or SBR metadata indicative of the spectral envelope of the highband signal. In particular, the lookahead may allow a corresponding audio encoder to determine the HFR or SBR metadata of the particular frame of the audio signal, based on a pre-determined number of samples from a directly succeeding frame of the audio signal. This may be beneficial in cases where the particular frame comprises an acoustic transient. The lookahead delay may be applied by a lookahead delay unit comprised within the waveform processing path.

As such, the overall delay of the waveform processing path, i.e. the waveform delay may be dependent on the different processing which is performed within the waveform processing path. Furthermore, the waveform delay may be dependent on the metadata delay, which is introduced in the metadata processing path. The waveform delay may correspond to an arbitrary multiple of a sample of the audio signal. For this reason, it may be beneficial to make use of a waveform delay unit which is configured to delay the waveform signal, wherein the waveform signal is represented in the time domain. In other words, it may be beneficial to apply the waveform delay on the waveform signal. By doing this, a precise and consistent application of a waveform delay, which corresponds to an arbitrary multiple of a sample of the audio signal, may be ensured.

An example decoder may comprise a metadata delay unit, which is configured to apply the metadata delay on the metadata, wherein the metadata may be represented in the subband domain, and a waveform delay unit, which is configured to apply the waveform delay on the waveform signal which is represented in the time domain. The metadata delay unit may apply a metadata delay which corresponds to an integer multiple of the frame length N, and the waveform delay unit may apply a waveform delay which corresponds to an integer multiple of a sample of the audio signal. As a consequence, a precise and consistent alignment of the plurality of waveform subband signals and of the decoded metadata for processing within the metadata application and synthesis unit may be ensured. The processing of the plurality of waveform subband signals and of the decoded metadata may occur in the subband domain. The alignment of the plurality of waveform subband signals and of the decoded metadata may be achieved without resampling of the decoded metadata, thereby providing computationally efficient and quality preserving means for alignment.

As outlined above, the audio decoder may be configured to perform an HFR or SBR scheme. The metadata application and synthesis unit may comprise a metadata application unit which is configured to perform high frequency reconstruction (such as SBR) using the plurality of lowband subband signals and using the decoded metadata. In particular, the metadata application unit may be configured to transpose one or more of the plurality of lowband subband signals to generate a plurality of highband subband signals. Furthermore, the metadata application unit may be configured to apply the decoded metadata to the plurality of highband subband signals to provide a plurality of scaled highband subband signals. The plurality of scaled highband subband signals may be indicative of the highband signal of the reconstructed frame of the audio signal. For generating the reconstructed frame of the audio signal, the metadata application and synthesis unit may further comprise a synthesis unit configured to generate the reconstructed frame of the audio signal from the plurality of lowband subband signals and from the plurality of scaled highband subband signals. The synthesis unit may be configured to perform an inverse transform with respect to the transform performed by the analysis unit, e.g. by applying an inverse QMF bank. The number of filters comprised within the filter bank of the synthesis unit may be higher than the number of filters comprised within the filter bank of the analysis unit (e.g. in order to account for the extended frequency range due to the plurality of scaled highband subband signals).

As indicated above, the audio decoder may comprise an expanding unit. The expanding unit may be configured to modify (e.g. increase) the dynamic range of the plurality of waveform subband signals. The expanding unit may be positioned upstream of the metadata application and synthesis unit. In particular, the plurality of expanded waveform subband signals may be used for performing the HFR or SBR scheme. In other words, the plurality of lowband subband signals used for performing the HFR or SBR scheme may correspond to the plurality of expanded waveform subband signals at the output of the expanding unit.

The expanding unit is preferable positioned downstream of the lookahead delay unit. In particular, the expanding unit may be positioned between the lookahead delay unit and the metadata application and synthesis unit. By positioning the expanding unit downstream of the lookahead delay unit, i.e. by applying the lookahead delay to the waveform data prior to expanding the plurality of waveform subband signals, it is ensured that the one or more expanding parameters comprised within the metadata are applied to the correct waveform data. In other words, performing expansion on the waveform data which has already been delayed by the lookahead delay ensures that the one or more expanding parameters from the metadata are in synchronicity with the waveform data.

As such, the decoded metadata may comprise one or more expanding parameters, and the audio decoder may comprise an expanding unit configured to generate a plurality of expanded waveform subband signals based on the plurality of waveform subband signals, using the one or more expanding parameters. In particular, the expanding unit may be configured to generate the plurality of expanded waveform subband signals using an inverse of a pre-determined compression function. The one or more expanding parameters may be indicative of the inverse of the pre-determined compression function. The reconstructed frame of the audio signal may be determined from the plurality of expanded waveform subband signals.

As indicated above, the audio decoder may comprise a lookahead delay unit configured to delay the plurality of waveform subband signals in accordance to the pre-determined lookahead, to yield a plurality of delayed waveform subband signals. The expanding unit may be configured to generate the plurality of expanded waveform subband signals by expanding the plurality of delayed waveform subband signals. In other words, the expanding unit may be positioned downstream of the lookahead delay unit. This ensures synchronicity between the one or more expanding parameters and the plurality of waveform subband signals, to which the one or more expanding parameters are applicable.

The metadata application and synthesis unit may be configured to generate the reconstructed frame of the audio signal by using the decoded metadata (notably by using the SBR/HFR related metadata) for a temporal portion of the plurality of waveform subband signals. The temporal portion may correspond to a number of time slots of the plurality of waveform subband signals. The temporal length of the temporal portion may be variable, i.e. the temporal length of the temporal portion of the plurality of waveform subband signals to which the decoded metadata is applied may vary from one frame to the next. In yet other words, the framing for the decoded metadata may vary. The variation of the temporal length of a temporal portion may be limited to pre-determined bounds. The pre-determined bounds may correspond to the frame length minus the lookahead delay and to the frame length plus the lookahead delay, respectively. The application of the decoded waveform data (or parts thereof) for temporal portions of different temporal lengths may be beneficial for handling transient audio signals.

The expanding unit may be configured to generate the plurality of expanded waveform subband signals by using the one or more expanding parameters for the same temporal portion of the plurality of waveform subband signals. In other words, the framing of the one or more expanding parameters may be the same as the framing for the decoded metadata which is used by the metadata application and synthesis unit (e.g. the framing for the SBR/HFR metadata). By doing this, consistency of the SBR scheme and of the companding scheme can be ensured and the perceptual quality of the coding system can be improved.

According to a further aspect, an audio encoder configured to encode a frame of an audio signal into an access unit of a data stream is described. The audio encoder may be configured to perform corresponding processing tasks with respect to the processing tasks performed by the audio decoder. In particular, the audio encoder may be configured to determine waveform data and metadata from the frame of the audio signal and to insert the waveform data and the metadata into an access unit. The waveform data and the metadata may be indicative of a reconstructed frame of the frame of the audio signal. In other words, the waveform data and the metadata may enable the corresponding audio decoder to determine a reconstructed version of the original frame of the audio signal. The frame of the audio signal may comprise a lowband signal and a highband signal. The waveform data may be indicative of the lowband signal and the metadata may be indicative of a spectral envelope of the highband signal.

The audio encoder may comprise a waveform processing path configured to generate the waveform data from the frame of the audio signal, e.g. from the lowband signal (e.g. using an audio core decoder such as an Advanced Audio Coder, AAC). Furthermore, the audio encoder comprises a metadata processing path configured to generate the metadata from the frame of the audio signal, e.g. from the highband signal and from the lowband signal. By way of example, the audio encoder may be configured to perform High Efficiency (HE) AAC, and the corresponding audio decoder may be configured to decode the received data stream in accordance to HE AAC.

The waveform processing path and/or the metadata processing path may comprise at least one delay unit configured to time-align the waveform data and the metadata such that the access unit for the frame of the audio signal comprises the waveform data and the metadata for the same frame of the audio signal. The at least one delay unit may be configured to time-align the waveform data and the metadata such that an overall delay of the waveform processing path corresponds to an overall delay of metadata processing path. In particular, the at least one delay unit may be a waveform delay unit configured to insert an additional delay in the waveform processing path, such that the overall delay of the waveform processing path corresponds to the overall delay of the metadata processing path. Alternatively or in addition, the at least one delay unit may be configured to time-align the waveform data and the metadata such that the waveform data and the metadata are provided to an access unit generation unit of the audio encoder just-in-time for generating a single access unit from the waveform data and from the metadata. In particular, the waveform data and the metadata may be provided such that the single access unit may be generated without the need for a buffer for buffering the waveform data and/or the metadata.

The audio encoder may comprise an analysis unit configured to generate a plurality of subband signals from the frame of the audio signal, wherein the plurality of subband signals may comprise a plurality of lowband signals indicative of the lowband signal. The audio encoder may comprise a compression unit configured to compress the plurality of lowband signals using a compression function, to provide a plurality of compressed lowband signals. The waveform data may be indicative of the plurality of compressed lowband signals and the metadata may be indicative of the compression function used by the compression unit. The metadata indicative of the spectral envelope of the highband signal may be applicable to the same portion of the audio signal as the metadata indicative of the compression function. In other words, the metadata indicative of the spectral envelope of the highband signal may be in synchronicity with the metadata indicative of the compression function According to a further aspect, a data stream comprising a sequence of access units for a sequence of frames of an audio signal, respectively, is described. An access unit from the sequence of access units comprises waveform data and metadata. The waveform data and the metadata are associated with the same particular frame of the sequence of frames of the audio signal. The waveform data and the metadata may be indicative of a reconstructed frame of the particular frame. In an example, the particular frame of the audio signal comprises a lowband signal and a highband signal, wherein the waveform data is indicative of the lowband signal and wherein the metadata is indicative of a spectral envelope of the highband signal. The metadata may enable an audio decoder to generate the highband signal from the lowband signal, using an HFR scheme. Alternatively or in addition, the metadata may be indicative of a compression function applied to the lowband signal. Hence, the metadata may enable the audio decoder to perform an expansion of the dynamic range of the received lowband signal (using an inverse of the compression function).

According to a further aspect, a method for determining a reconstructed frame of an audio signal from an access unit of a received data stream is described. The access unit comprises waveform data and metadata, wherein the waveform data and the metadata are associated with the same reconstructed frame of the audio signal. In an example, the reconstructed frame of the audio signal comprises a lowband signal and a highband signal, wherein the waveform data is indicative of the lowband signal (e.g. of frequency coefficients describing the lowband signal) and wherein the metadata is indicative of a spectral envelope of the highband signal (e.g. of scale factors for a plurality of scale factor bands of the highband signal). The method comprises generating a plurality of waveform subband signals from the waveform data and generating decoded metadata from the metadata. Furthermore, the method comprises time-aligning the plurality of waveform subband signals and the decoded metadata, as described in the present document. In addition, the method comprises generating the reconstructed frame of the audio signal from the time-aligned plurality of waveform subband signals and decoded metadata.

According to another aspect, a method for encoding a frame of an audio signal into an access unit of a data stream is described. The frame of the audio signal is encoded such that the access unit comprises waveform data and metadata. The waveform data and the metadata are indicative of a reconstructed frame of the frame of the audio signal, In an example, the frame of the audio signal comprises a lowband signal and a highband signal, and the frame is encoded such that the waveform data is indicative of the lowband signal and such that the metadata is indicative of a spectral envelope of the highband signal. The method comprises generating the waveform data from the frame of the audio signal, e.g. from the lowband signal and generating the metadata from the frame of the audio signal, e.g. from the highband signal and from the lowband signal (e.g. in accordance to an HFR scheme). In addition, the method comprises time-aligning the waveform data and the metadata such that the access unit for the frame of the audio signal comprises the waveform data and the metadata for the same frame of the audio signal.

According to a further aspect, a software program is described. The software program may be adapted for execution on a processor and for performing the method steps outlined in the present document when carried out on the processor.

According to another aspect, a storage medium (e.g. a non-transitory storage medium) is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

Figure 2A:
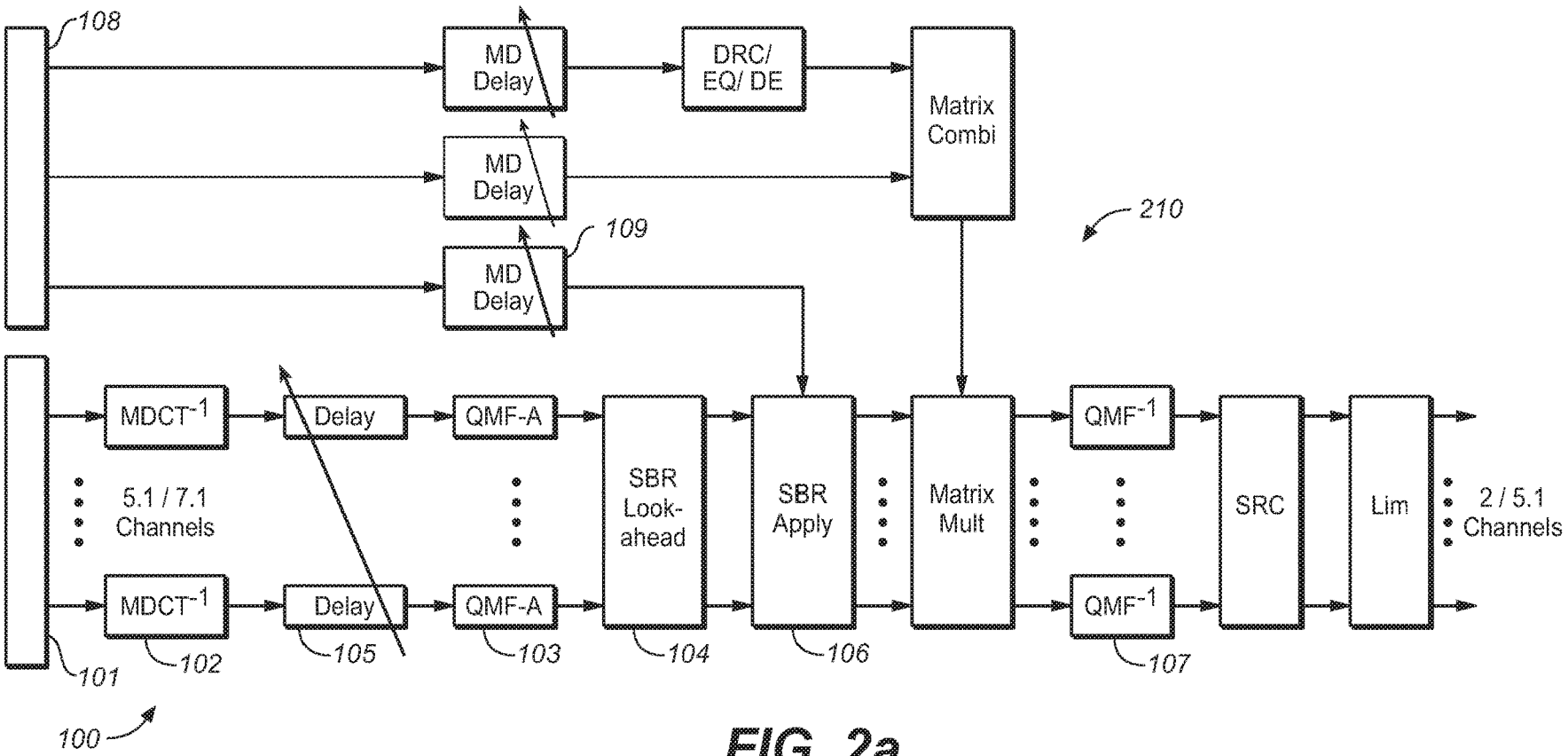
Figure 2B:
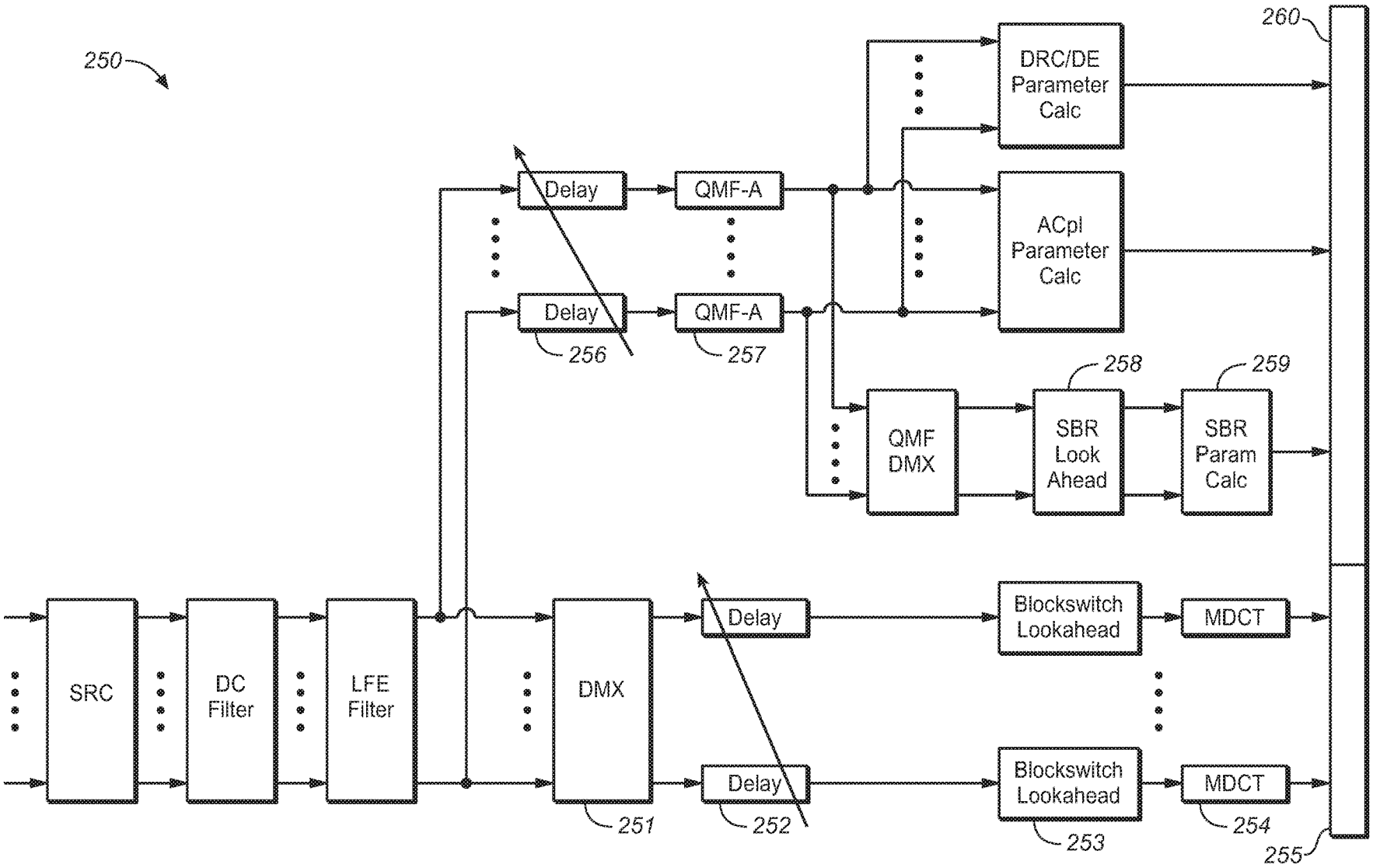

The invention is explained below in an illustrative manner with reference to the accompanying drawings, wherein FIG. 1 shows a block diagram of an example audio decoder;

FIG. 2*a* shows a block diagram of another example audio decoder;

FIG. 2*b* shows a block diagram of an example audio encoder; and

Figure 3A:
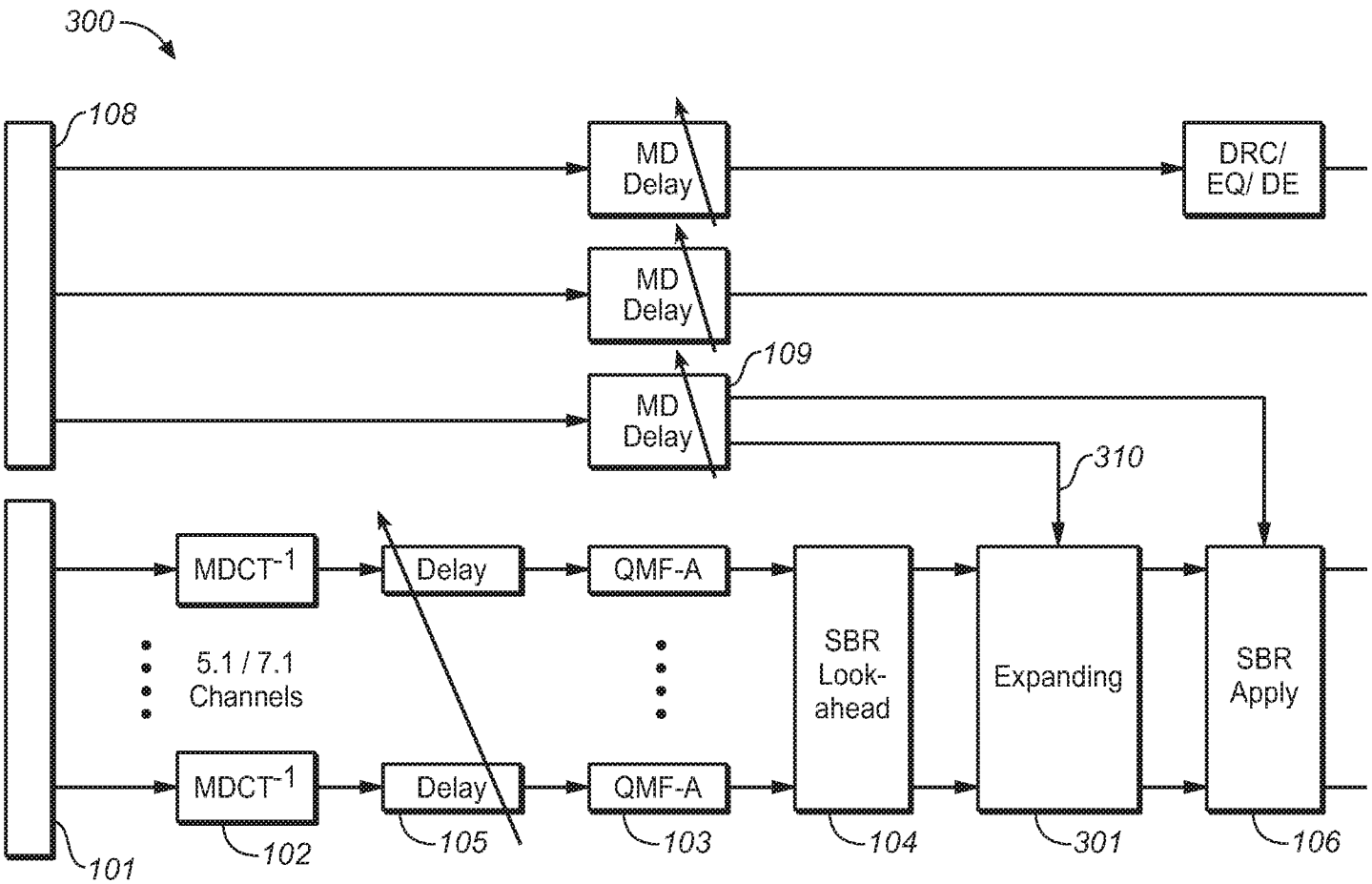
Figure 3B:
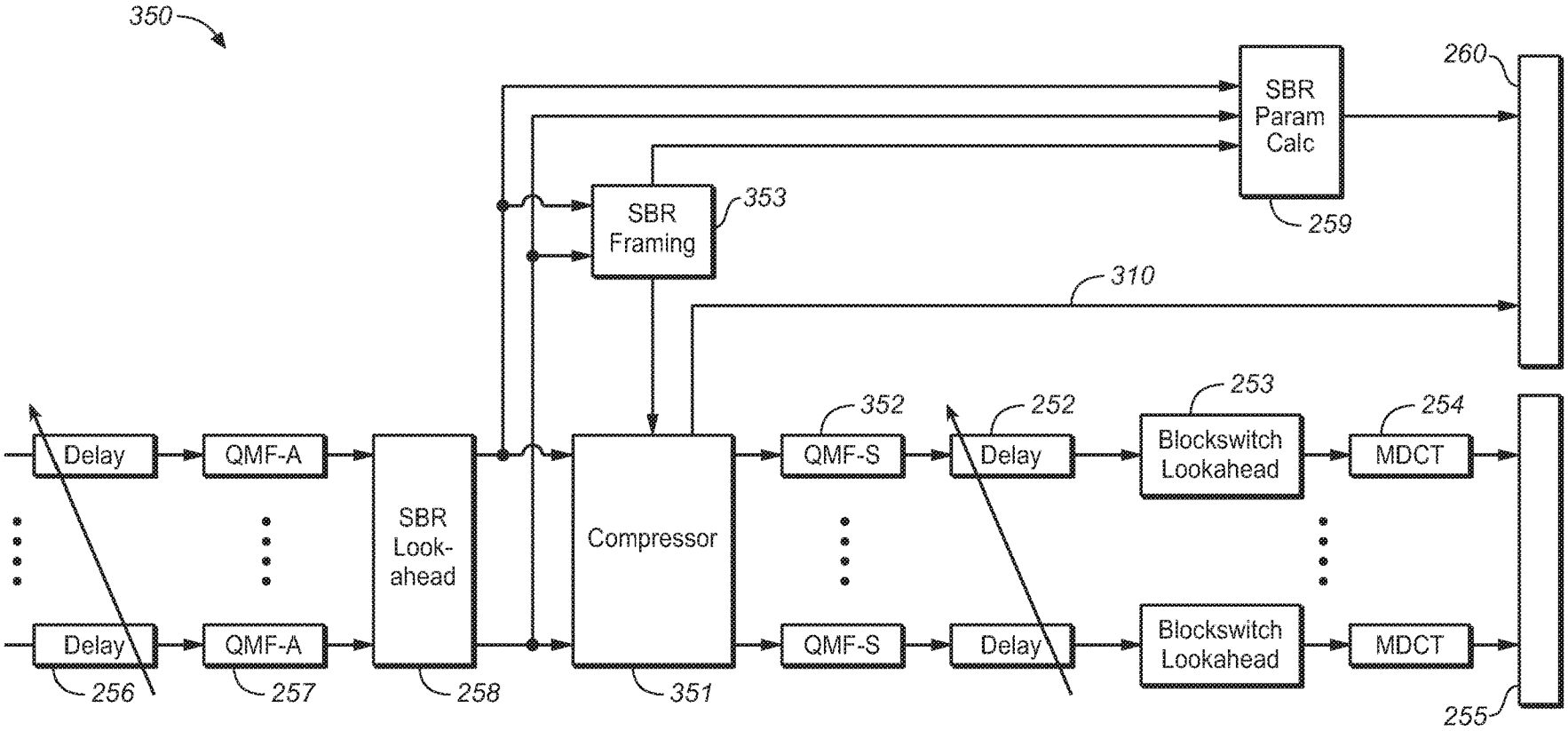
Figure 4:
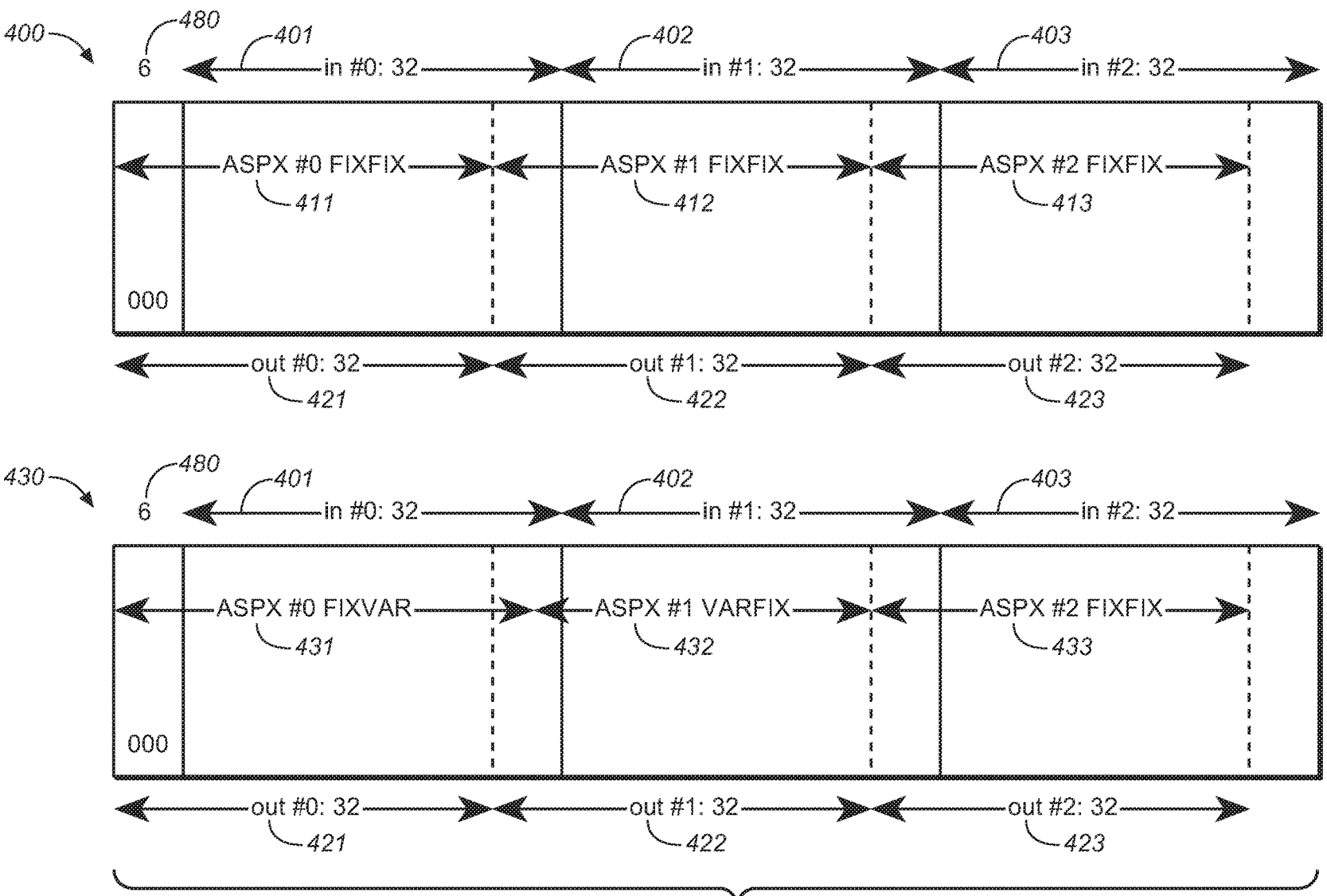

FIG. 3*a* shows a block diagram of an example audio decoder which is configured to perform audio expansion;

FIG. 3*b* shows a block diagram of an example audio encoder which is configured to perform audio compression; and FIG. 4 illustrates an example framing of a sequence of frames of an audio signal.

DETAILED DESCRIPTION OF THE INVENTION

As indicated above, the present document relates to metadata alignment. In the following the alignment of metadata is outlined in the context of an MPEG HE (High Efficiency) AAC (Advanced Audio Coding) scheme. It should be noted, however, that the principles of metadata alignment which are described in the present document are also applicable to other audio encoding/decoding systems. In particular, the metadata alignment schemes which are described in the present document are applicable to audio encoding/decoding systems which make use of HFR (High Frequency Reconstruction) and/or SBR (Spectral Bandwidth Replication) and which transmit HFR/SBR metadata from an audio encoder to a corresponding audio decoder. Furthermore, the metadata alignment schemes which are described in the present document are applicable to audio encoding/decoding systems which make use of applications in a subband (notable a QMF) domain. An example for such an application is SBR. Other examples are A-coupling, post-processing, etc. In the following, the metadata alignment schemes are described in the context of the alignment of SBR metadata. It should be noted, however, that the metadata alignment schemes are also applicable to other types of metadata, notably to other types of metadata in the subband domain.

An MPEG HE-AAC data stream comprises SBR metadata (also referred to as A-SPX metadata). The SBR metadata in a particular encoded frame of the data stream (also referred to as an AU (access unit) of the data stream) typically relates to waveform (W) data in the past. In other words, The SBR metadata and the waveform data comprised within an AU of the data stream typically do not correspond to the same frame of the original audio signal. This is due to the fact that after decoding of the waveform data, the waveform data is submitted to several processing steps (such as an IMDCT (inverse Modified Discrete Cosine Transform and a QMF (Quadrature Mirror Filter) Analysis) which introduce a signal delay. At the point where the SBR metadata is applied to the waveform data, the SBR metadata is in synchronicity with the processed waveform data. As such, the SBR metadata and the waveform data are inserted into the MPEG HE-AAC data stream such that the SBR metadata reaches the audio decoder, when the SBR metadata is needed for SBR processing at the audio decoder. This form of metadata delivery may be referred to as "Just-In-Time" (JIT) metadata delivery, as the SBR metadata is inserted into the data stream such that the SBR metadata can be directly applied within the signal or processing chain of the audio decoder.

JIT metadata delivery may be beneficial for a conventional encode—transmit—decode processing chain, in order to reduce the overall coding delay and in order to reduce memory requirements at the audio decoder. However, a splice of the data stream along the transmission path may lead to a mismatch between the waveform data and the corresponding SBR metadata. Such a mismatch may lead to audible artifacts at the splicing point because wrong SBR metadata is used for spectral band replication at the audio decoder.

In view of the above, it is desirable to provide an audio encoding/decoding system which allows for the splicing of data streams, while at the same time maintaining a low overall coding delay.

FIG. 1 shows a block diagram of an example audio decoder 100 which addresses the above mentioned technical problem. In particular, the audio decoder 100 of FIG. 1 allows for the decoding of data streams with AUs 110 which comprise the waveform data 111 of a particular segment (e.g. frame) of an audio signal and which comprise the corresponding metadata 112 of the particular segment of the audio signal. By providing audio decoders 100 that decode data streams comprising AUs 110 with time-aligned waveform data 111 and corresponding metadata 112, consistent splicing of the data stream is enabled. In particular, it is ensured that the data stream can be spliced in such a manner that corresponding pairs of waveform data 111 and metadata 112 are maintained.

The audio decoder 100 comprises a delay unit 105 within the processing chain of the waveform data 111. The delay unit 105 may be placed post or downstream of the MDCT synthesis unit 102 and prior or upstream of the QMF synthesis unit 107 within the audio decoder 100. In particular, the delay unit 105 may be placed prior or upstream of the metadata application unit 106 (e.g. the SBR unit 106) which is configured to apply the decoded metadata 128 to the processed waveform data. The delay unit 105 (also referred to as the waveform delay unit 105) is configured to apply a delay (referred to as the waveform delay) to the processed waveform data. The waveform delay is preferably chosen so that the overall processing delay of the waveform processing chain or the waveform processing path (e.g. from the MDCT synthesis unit 102 to the application of metadata in the metadata application unit 106) sums up to exactly one frame (or to an integer multiple thereof). By doing so, the parametric control data can be delayed by a frame (or a multiple thereof) and alignment within the AU 110 is achieved.

FIG. 1 shows components of an example audio decoder 100. The waveform data 111 taken from an AU 110 is decoded and de-quantized within a waveform decoding and de-quantization unit 101 to provide a plurality of frequency coefficients 121 (in the frequency domain). The plurality of frequency coefficients 121 are synthesized into a (time domain) lowband signal 122 using a frequency domain to time domain transform (e.g. an inverse MDCT, Modified Discrete Cosine Transform) applied within the lowband synthesis unit 102 (e.g. the MDCT synthesis unit). Subsequently, the lowband signal 122 is transformed into a plurality of lowband subband signals 123 using an analysis unit 103. The analysis unit 103 may be configured to apply a quadrature mirror filter (QMF) bank to the lowband signal 122 to provide the plurality of lowband subband signals 123. The metadata 112 is typically applied to the plurality of lowband subband signals 123 (or to transposed versions thereof).

The metadata 112 from the AU 110 is decoded and de-quantized within a metadata decoding and de-quantization unit 108 to provide the decoded metadata 128. Furthermore, the audio decoder 100 may comprise a further delay unit 109 (referred to as the metadata delay unit 109) which is configured to apply a delay (referred to as the metadata delay) to the decoded metadata 128. The metadata delay may correspond to an integer multiple of the frame length N, e.g. $D_1$=N, wherein $D_1$ is the metadata delay. As such, the overall delay of the metadata processing chain corresponds to $D_1$, e.g. $D_1$=N.

In order to ensure that the processed waveform data (i.e. the delayed plurality of lowband subband signals 123) and the processed metadata (i.e. the delayed decoded metadata 128) arrive at the metadata application unit 106 at the same time, the overall delay of the waveform processing chain (or path) should correspond to the overall delay of the metadata processing chain (or path) (i.e. to $D_1$). Within the waveform processing chain, the lowband synthesis unit 102 typically inserts a delay of N/2 (i.e. of half the frame length). The analysis unit 103 typically inserts a fixed delay (e.g. of 320 samples). Furthermore, a lookahead (i.e. a fixed offset between metadata and waveform data) may need to be taken into account. In the case of MPEG HE-AAC such an SBR lookahead may correspond to 384 samples (represented by the lookahead unit 104). The lookahead unit 104 (which may also be referred to as the lookahead delay unit 104) may be configured to delay the waveform data 111 (e.g. delay the plurality of lowband subband signals 123) by a fixed SBR lookahead delay. The lookahead delay enables a corresponding audio encoder to determine the SBR metadata based on a succeeding frame of the audio signal.

In order to provide an overall delay of the metadata processing chain which corresponds to an overall delay of the waveform processing chain, the waveform delay $D_2$ should be such that:

$$D_1=320+384+D_2+N/2,$$

i.e. $D_2=N/2-320-384$ (in case of $D_1=N$).

Table 1 shows the waveform delays $D_2$ for a plurality of different frame lengths N. It can be seen that the maximum waveform delay $D_2$ for the different frame lengths N of HE-AAC is 928 samples with an overall maximum decoder latency of 2177 samples. In other words, the alignment of the waveform data 111 and the corresponding metadata 112 within a single AU 110 results in a maximum of 928 samples additional PCM delay. For the block of frame sizes N=1920/1536, the metadata is delayed by 1 frame, and for frame sizes N=960/768/512/384 the metadata is delayed by 2 frames. This means that the play out delay at the audio decoder 100 is increased in dependence of the block size N, and the overall coding delay is increased by 1 or 2 full frames. The maximum PCM delay at the corresponding audio encoder is 1664 samples (corresponding to the inherent latency of the audio decoder 100).

TABLE 1

| N | Inverse MDCT (N/2) | QMF analysis | SBR Lookahead | Inherent latency (Σ) | $D_2$ | Nb. of frames | $D_1$ | QMF synthesis | Overall Decoder latency |
|---|---|---|---|---|---|---|---|---|---|
| 1920 | 960 | 320 | 384 | 1664 | 256 | 1 | 1920 | 257 | 2177 |
| 1536 | 768 | 320 | 384 | 1472 | 64 | 1 | 1536 | 257 | 1793 |
| 960 | 480 | 320 | 192 | 992 | 928 | 2 | 1920 | 257 | 2177 |
| 768 | 384 | 320 | 192 | 896 | 640 | 2 | 1536 | 257 | 1793 |
| 512 | 256 | 320 | 192 | 768 | 256 | 2 | 1024 | 257 | 1281 |
| 384 | 192 | 320 | 192 | 704 | 64 | 2 | 768 | 257 | 1025 |

As such, it is proposed in the present document to address the drawback of JIT metadata, by the use of signal-aligned-metadata 112 (SAM) which is aligned with the corresponding waveform data 111 into a single AU 110. In particular, it is proposed to introduce one or more additional delay units into an audio decoder 100 and/or into a corresponding audio encoder such that every encoded frame (or AU) carries the (e.g. A-SPX) metadata it uses at a later processing stage, e.g. at the processing stage when the metadata is applied to the underlying waveform data.

It should be noted that—in principle—it could be considered to apply a metadata delay $D_1$ which corresponds to a fraction of the frame length N. By doing this, the overall coding delay could possibly be reduced. However, as shown e.g. in FIG. 1, the metadata delay $D_1$ is applied in the QMF domain (i.e. in the subband domain). In view of this and in view of the fact that the metadata 112 is typically only defined once per frame, i.e. in view of the fact that the metadata 112 typically comprises one dedicated parameter set per frame, the insertion of a metadata delay $D_1$ which corresponds to a fraction of a frame length N may lead to synchronization issues with respect to the waveform data 111. On the other hand, the waveform delay $D_2$ is applied in the time-domain (as shown in FIG. 1), where delays which correspond to a fraction of a frame can be implemented in a precise manner (e.g. by delaying the time domain signal by a number of samples which corresponds to the waveform delay $D_2$). Hence, it is beneficial to delay the metadata 112 by integer multiples of a frame (wherein the frame corresponds to the lowest time resolution for which the metadata 112 is defined) and to delay the waveform data 111 by a waveform delay $D_2$ which may take on arbitrary values. A metadata delay $D_1$ which corresponds to an integer multiple of the frame length N can be implemented in the subband domain in a precise manner, and a waveform delay $D_2$ which corresponds to an arbitrary multiple of a sample can be implemented in the time domain in a precise manner. Consequently, the combination of a metadata delay $D_1$ and a waveform delay $D_2$ allows for an exact synchronization of the metadata 112 and the waveform data 111.

The application of a metadata delay $D_1$ which corresponds to a fraction of the frame length N could be implemented by re-sampling the metadata 112, in accordance to the metadata delay $D_1$. However, the re-sampling of the metadata 112 typically involves substantial computational costs. Furthermore, the re-sampling of the metadata 112 may lead to a distortion of the metadata 112, thereby affecting the quality of the reconstructed frame of the audio signal. In view of this, it is beneficial, in view of computational efficiency and in view of audio quality, to limit the metadata delay $D_1$ to integer multiples of the frame length N.

FIG. 1 also shows the further processing of the delayed metadata 128 and the delayed plurality of lowband subband signals 123. The metadata application unit 106 is configured to generate a plurality of (e.g. scaled) highband subband signals 126 based on the plurality of lowband subband signals 123 and based on the metadata 128. For this purpose, the metadata application unit 106 may be configured to transpose one or more of the plurality of lowband subband signals 123 to generate a plurality of highband subband signals. The transposition may comprise a copy-up process of the one or more of the plurality of lowband subband signals 123. Furthermore, the metadata application unit 106 may be configured to apply the metadata 128 (e.g. scale factors comprised within the metadata 128) to the plurality of highband subband signals, in order to generate the plurality of scaled highband subband signals 126. The plurality of scaled highband subband signals 126 is typically scaled using the scale factors, such that the spectral envelope of the plurality of scaled highband subband signals 126 mimics the spectral envelope of the highband signal of an original frame of the audio signal (which corresponds to a reconstructed frame of the audio signal 127 that is generated based on the plurality of lowband subband signals 123 and from the plurality of scaled highband subband signals 126).

Furthermore, the audio decoder 100 comprises a synthesis unit 107 configured to generate the reconstructed frame of an audio signal 127 from the plurality of lowband subband signals 123 and from the plurality of scaled highband subband signals 126 (e.g. using an inverse QMF bank).

FIG. 2*a* shows a block diagram of another example audio decoder 100. The audio decoder 100 of FIG. 2*a* comprises the same components as the audio decoder 100 of FIG. 1. Furthermore, example components 210 for multi-channel audio processing are illustrated. It can be seen that in the example of FIG. 2*a*, the waveform delay unit 105 is positioned directly subsequent to the inverse MDCT unit 102. The determination of a reconstructed frame of an audio signal 127 may be performed for each channel of a multi-channel audio signal (e.g. of a 5.1 or a 7.1 multi-channel audio signal).

FIG. 2*b* shows a block diagram of an example audio encoder 250 corresponding to the audio decoder 100 of FIG. 2*a*. The audio encoder 250 is configured to generate a data stream comprising AUs 110 which carries pairs of corresponding waveform data 111 and metadata 112. The audio encoder 250 comprises a metadata processing chain 256, 257, 258, 259, 260 for determining the metadata. The metadata processing chain may comprise a metadata delay unit 256 for aligning the metadata with the corresponding waveform data. In the illustrated example, the metadata delay unit 256 of the audio encoder 250 does not introduce any additional delay (because the delay introduced by the metadata processing chain is greater than the delay introduced by the waveform processing chain).

Furthermore, the audio encoder 250 comprises a waveform processing chain 251, 252, 253, 254, 255 configured to determine the waveform data from an original audio signal at the input of the audio encoder 250. The waveform processing chain comprises a waveform delay unit 252 configured to introduce an additional delay into the waveform processing chain, in order to align the waveform data with the corresponding metadata. The delay which is introduced by the waveform delay unit 252 may be such that the overall delay of the metadata processing chain (including the waveform delay inserted by the waveform delay unit 252) corresponds to the overall delay of the waveform processing chain. In case of a frame length N=2048, the delay of the waveform delay unit 252 may be 2048−320=1728 samples.

FIG. 3*a* shows an excerpt of an audio decoder 300 which comprises an expanding unit 301. The audio decoder 300 of FIG. 3*a* may correspond to the audio decoder 100 of FIGS. 1 and/or 2*a* and further comprises the expanding unit 301 which is configured to determine a plurality of expanded lowband signals from the plurality of lowband signals 123, using one or more expanding parameters 310 taken from the decoded metadata 128 of an access unit 110. Typically, the one or more expanding parameters 310 are coupled with SBR (e.g. A-SPX) metadata comprised within an access unit 110. In other words, the one or more expanding parameters 310 are typically applicable to the same excerpt or portion of an audio signal as the SBR metadata.

As outlined above, the metadata 112 of an access unit 110 is typically associated with the waveform data 111 of a frame of an audio signal, wherein the frame comprises a predetermined number N of samples. The SBR metadata is typically determined based on a plurality of lowband signals (also referred to as a plurality of waveform subband signals), wherein the plurality of lowband signals may be determined using a QMF analysis. The QMF analysis yields a time-frequency representation of a frame of an audio signal. In particular, the N samples of a frame of an audio signal may be represented by Q (e.g. Q=64) lowband signals, each comprising N/Q time slots or slots. For a frame with N=2048 samples and for Q=64, each lowband signal comprises N/Q=32 slots.

In case of a transient within a particular frame, it may be beneficial to determine the SBR metadata based on samples of a directly succeeding frame. This feature is referred to as the SBR lookahead. In particular, the SBR metadata may be determined based on a pre-determined number of slots from the succeeding frame. By way of example, up to 6 slots of the succeeding frame may be taken into consideration (i.e. Q*6=384 samples).

The use of the SBR lookahead is illustrated in FIG. 4 which shows a sequence of frames 401, 402, 403 of an audio signal, using different framings 400, 430 for the SBR or HFR scheme. In the case of framing 400, the SBR/HFR scheme does not make use of the flexibility provided by the SBR lookahead. Nevertheless, a fixed offset, i.e. a fixed SBR lookahead delay, 480 is used to enable the use of the SBR lookahead. In the illustrated example, the fixed offset corresponds to 6 time slots. As a result of this fixed offset 480, the metadata 112 of a particular access unit 110 of a particular frame 402 is partially applicable to time slots of waveform data 111 comprised within the access unit 110 which precedes the particular access unit 110 (and which is associated with the directly preceding frame 401). This is illustrated by the offset between the SBR metadata 411, 412, 413 and the frames 401, 402, 403. Hence, the SBR metadata 411, 412, 413 comprised within an access unit 110 may be applicable to waveform data 111 which is offset by the SBR lookahead delay 480. The SBR metadata 411, 412, 413 is applied to the waveform data 111 to provide the reconstructed frames 421, 422, 423.

The framing 430 makes use of the SBR lookahead. It can be seen that the SBR metadata 431 is applicable to more than 32 time slots of waveform data 111, e.g. due to the occurrence of a transient within frame 401. On the other hand, the succeeding SBR metadata 432 is applicable to less than 32 time slots of waveform data 111. The SBR metadata 433 is again applicable to 32 time slots. Hence, the SBR lookahead allows for flexibility with regards to the temporal resolution of the SBR metadata. It should be noted that, regardless the use of the SBR lookahead and regardless the applicability of the SBR metadata 431, 432, 433, the reconstructed frames 421, 422, 423 are generated using a fixed offset 480 with respect to the frames 401, 402, 403.

An audio encoder may be configured to determine the SBR metadata and the one or more expanding parameters using the same excerpt or portion of the audio signal. Hence, if the SBR metadata is determined using an SBR lookahead, the one or more expanding parameters may be determined and may be applicable for the same SBR lookahead. In particular, the one or more expanding parameters may be applicable for the same number of time slots as the corresponding SBR metadata 431, 432, 433.

The expanding unit 301 may be configured to apply one or more expanding gains to the plurality of lowband signals 123, wherein the one or more expanding gains typically depend on the one or more expanding parameters 310. In particular, the one or more expanding parameters 310 may have an impact on one or more compression/expanding rules which are used to determined the one or more expanding gains. In other words, the one or more expanding parameters 310 may be indicative of the compression function which has been used by a compression unit of the corresponding audio encoder. The one or more expanding parameters 310 may enable the audio decoder to determine the inverse of this compression function.

The one or more expanding parameters 310 may comprise a first expanding parameter indicative of whether or not the corresponding audio encoder has compressed the plurality of lowband signals. If no compression has been applied, then no expansion will be applied by the audio decoder. As such, the first expanding parameter may be used to turn on or off the companding feature.

Alternatively or in addition, the one or more expanding parameters 310 may comprise a second expanding parameter indicative of whether or not the same one or more expansion gains are to be applied to all of the channels of a multi-channel audio signal. As such, the second expanding parameter may switch between a per-channel or a per-multi-channel application of the companding feature.

Alternatively or in addition, the one or more expanding parameters 310 may comprise a third expanding parameter indicative of whether or not to apply the same one or more expanding gains for all the time slots of a frame. As such, the third expanding parameter may be used to control the temporal resolution of the companding feature.

Using the one or more expanding parameters 310, the expanding unit 301 may determine the plurality of expanded lowband signals, by applying the inverse of a compression function applied at the corresponding audio encoder. The compression function which has been applied at the corresponding audio encoder is signaled to the audio decoder 300 using the one or more expanding parameters 310.

The expanding unit 301 may be positioned downstream of the lookahead delay unit 104. This ensures that the one or more expanding parameters 310 are applied to the correct portion of the plurality of lowband signals 123. In particular, this ensures that the one or more expanding parameters 310 are applied to the same portion of the plurality of lowband signals 123 as the SBR parameters (within the SBR application unit 106). As such, it is ensured that the expanding operates on the same time framing 400, 430 as the SBR scheme. Due to the SBR lookahead, the framing 400, 430 may comprise a variable number of time slots, and by consequence, the expanding may operate on a variable number of time slots (as outlined in the context of FIG. 4). By placing the expanding unit 301 downstream of the lookahead delay unit 104, it is ensured that the correct framing 400, 430 is applied to the one or more expanding parameters. As a result of this, a high quality audio signal can be ensured, even subsequent to a splicing point.

FIG. 3*b* shows an excerpt of an audio encoder 350 comprising a compression unit 351. The audio encoder 350 may comprise the components of the audio encoder 250 of FIG. 2*b*. The compression unit 351 may be configured to compress (e.g. reduce the dynamic range) of the plurality of lowband signals, using a compression function. Furthermore, the compression unit 351 may be configured to determine one or more expanding parameters 310 which are indicative of the compression function that has been used by the compression unit 351, to enable a corresponding expanding unit 301 of an audio decoder 300 to apply an inverse of the compression function.

The compression of the plurality of lowband signals may be performed downstream of an SBR lookahead 258. Furthermore, the audio encoder 350 may comprise an SBR framing unit 353 which is configured to ensure that the SBR metadata is determined for the same portion of the audio signal as the one or more expanding parameters 310. In other words, the SBR framing unit 353 may ensure that the SBR scheme operates on the same framing 400, 430 as the companding scheme. In view of the fact that the SBR scheme may operate on extended frames (e.g. in case of transients), the companding scheme may also operate on extended frames (comprising additional time slots).

In the present document, an audio encoder and a corresponding audio decoder have been described which allow for the encoding of an audio signal into a sequence of time-aligned AUs comprising waveform data and metadata associated with a sequence of segments of the audio signal, respectively. The use of time-aligned AUs enables the splicing of data streams with reduced artifacts at the splicing points. Furthermore, the audio encoder and audio decoder are designed such that the splicable data streams are processed in a computationally efficient manner and such that the overall coding delay remains low.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

Various aspects of the present invention may be appreciated from the following enumerated example embodiments (EEEs):

EEE1. An audio decoder configured to determine a reconstructed frame of an audio signal from an access unit of a received data stream; wherein the access unit comprises waveform data and metadata; wherein the waveform data and the metadata are associated with the same reconstructed frame of the audio signal; wherein the audio decoder comprises

- a waveform processing path configured to generate a plurality of waveform subband signals from the waveform data;
- a metadata processing path configured to generate decoded metadata from the metadata; and
- a metadata application and synthesis unit configured to generate the reconstructed frame of the audio signal from the plurality of waveform subband signals and from the decoded metadata; wherein the waveform processing path and/or the metadata processing path comprise at least one delay unit configured to time-align the plurality of waveform subband signals and the decoded metadata.

EEE2. The audio decoder of EEE 1, wherein the at least one delay unit is configured to time-align the plurality of waveform subband signals and the decoded metadata such that an overall delay of the waveform processing path corresponds to an overall delay of metadata processing path.

EEE3. The audio decoder of any previous EEE, wherein the at least one delay unit is configured to time-align the plurality of waveform subband signals and the decoded metadata such that the plurality of waveform subband signals and the decoded metadata are provided to the metadata application and synthesis unit just-in-time for the processing performed by the metadata application and synthesis unit.

EEE4. The audio of any previous EEE, wherein the metadata processing path comprises a metadata delay unit configured to delay the decoded metadata by an integer multiple greater zero of a frame length N of the reconstructed frame of the audio signal.

EEE5. The audio decoder of EEE 4, wherein the integer multiple is such that the delay introduced by the metadata delay unit is greater than a delay introduced by the processing of the waveform processing path.

EEE6. The audio decoder of any of EEEs 4 to 5, wherein the integer multiple is one for frame lengths N greater than 960 and wherein the integer multiple is two for frame lengths N smaller than or equal to 960.

EEE7. The audio decoder of any previous EEE, wherein the waveform processing path comprises a waveform delay unit configured to delay the plurality of waveform subband signals such that an overall delay of the waveform processing path corresponds to an integer multiple greater than zero of a frame length N of the reconstructed frame of the audio signal.

EEE8. The audio decoder of any previous EEE, wherein the waveform processing path comprises a decoding and de-quantization unit configured to decode and de-quantize the waveform data to provide a plurality of frequency coefficients indicative of the waveform signal;

a waveform synthesis unit configured to generate the waveform signal from the plurality of frequency coefficients; and an analysis unit configured to generate the plurality of waveform subband signals from the waveform signal.

EEE9. The audio decoder of EEE 8, wherein the waveform synthesis unit is configured to perform a frequency domain to time domain transform;

the analysis unit is configured to perform a time domain to subband domain transform; and a frequency resolution of the transform performed by the waveform synthesis unit is higher than a frequency resolution of the transform performed by the analysis unit.

EEE10. The audio decoder of EEE 9, wherein the waveform synthesis unit is configured to perform an inverse modified discrete cosine transform; and the analysis unit is configured to apply a quadrature mirror filter bank.

EEE11. The audio decoder of any of EEEs 8 to 10, wherein the waveform synthesis unit introduces a delay which depends on a frame length N of the reconstructed frame of the audio signal; and/or the analysis unit introduces a fixed delay which is independent of the frame length N of the reconstructed frame of the audio signal.

EEE12. The audio decoder of EEE 11, wherein the delay introduced by the waveform synthesis unit corresponds to half the frame length N; and/or the fixed delay introduced by the analysis unit corresponds to 320 samples of the audio signal.

EEE13. The audio decoder of any of EEEs 8 to 12, wherein the overall delay of the waveform processing path depends on a pre-determined lookahead between metadata and waveform data.

EEE14. The audio decoder of EEE13, wherein the predetermined lookahead corresponds to 192 or 384 samples of the audio sample.

EEE15. The audio decoder of any previous EEE, wherein the decoded metadata comprises one or more expanding parameters;

the audio decoder comprises an expanding unit configured to generate a plurality of expanded waveform subband signals based on the plurality of waveform subband signals, using the one or more expanding parameters; and the reconstructed frame of the audio signal is determined from the plurality of expanded waveform subband signals.

EEE16. The audio decoder of EEE 15, wherein the audio decoder comprises a lookahead delay unit configured to delay the plurality of waveform subband signals in accordance to a pre-determined lookahead, to yield a plurality of delayed waveform subband signals; and the expanding unit is configured to generate the plurality of expanded waveform subband signals by expanding the plurality of delayed waveform subband signals.

EEE17. The audio decoder of any of EEEs 15 to 16, wherein the expanding unit is configured to generate the plurality of expanded waveform subband signals using an inverse of a pre-determined compression function; and the one or more expanding parameters are indicative of the inverse of the pre-determined compression function.

EEE18. The audio decoder of any of EEEs 15 to 17, wherein the metadata application and synthesis unit is configured to generate the reconstructed frame of the audio signal by using the decoded metadata for a temporal portion of the plurality of waveform subband signals; and the expanding unit is configured to generate the plurality of expanded waveform subband signals by using the one or more expanding parameters for the same temporal portion of the plurality of waveform subband signals.

EEE19. The audio decoder of EEE 18, wherein a temporal length of the temporal portion of the plurality of waveform subband signals is variable.

EEE20. The audio decoder (of any of EEEs 8 to 19, wherein the waveform delay unit (105) is configured to delay the waveform signal; wherein the waveform signal is represented in the time domain.

EEE21. The audio decoder of any previous EEE, wherein the metadata application and synthesis unit is configured to process the decoded metadata and the plurality of waveform subband signals (in the subband domain.

EEE22. The audio decoder of any previous EEE, wherein the reconstructed frame of the audio signal comprises a lowband signal and a highband signal;

the plurality of waveform subband signals are indicative of the lowband signal;

the metadata is indicative of a spectral envelope of the highband signal; and the metadata application and synthesis unit comprises a metadata application unit which is configured to perform high frequency reconstruction using the plurality of waveform subband signals and the decoded metadata.

EEE23. The audio decoder of EEE 22, wherein the metadata application unit is configured to transpose one or more of the plurality of waveform subband signals to generate a plurality of highband subband signals; and apply the decoded metadata to the plurality of highband subband signals to provide a plurality of scaled highband subband signals; wherein the plurality of scaled highband subband signals is indicative of the highband signal of the reconstructed frame of the audio signal.

EEE24. The audio decoder of EEE 23, wherein the metadata application and synthesis unit, further comprises a synthesis unit configured to generate the reconstructed frame of the audio signal from the plurality of waveform subband signals and from the plurality of scaled highband subband signals.

EEE25. The audio decoder of EEE 24 referring back to EEE 9, wherein the synthesis unit is configured to perform an inverse transform with respect to the transform performed by the analysis unit.

EEE26. An audio encoder configured to encode a frame of an audio signal into an access unit of a data stream; wherein the access unit comprises waveform data and metadata;

wherein the waveform data and the metadata are indicative of a reconstructed frame of the frame of the audio signal; wherein the audio encoder comprises a waveform processing path configured to generate the waveform data from the frame of the audio signal; and a metadata processing path configured to generate the metadata from the frame of the audio signal; wherein the waveform processing path and/or the metadata processing path comprise at least one delay unit configured to time-align the waveform data and the metadata such that the access unit for the frame of the audio signal comprises the waveform data and the metadata for the same frame of the audio signal.

EEE27. The audio encoder of EEE 26, wherein the at least one delay unit is configured to time-align the waveform data and the metadata such that an overall delay of the waveform processing path corresponds to an overall delay of the metadata processing path.

EEE28. The audio encoder of any of EEEs 26 to 27, wherein the at least one delay unit is configured to time-align the waveform data and the metadata such that the waveform data and the metadata are provided to an access unit generation unit of the audio encoder just-in-time for generating a single access unit from the waveform data and from the metadata.

EEE29. The audio encoder of any of EEEs 26 to 28, wherein the waveform processing path comprises a waveform delay unit configured to insert a delay into the waveform processing path.

EEE30. The audio encoder of any of EEEs 26 to 29, wherein the frame of the audio signal comprises a lowband signal and a highband signal;

the waveform data is indicative of the lowband signal;

the metadata is indicative of a spectral envelope of the highband signal;

the waveform processing path is configured to generate the waveform data from the lowband signal; and the metadata processing path is configured to generate the metadata from the lowband signal and from the highband signal.

EEE31. The audio encoder of EEE 30, wherein the audio encoder comprises an analysis unit configured to generate a plurality of subband signals from the frame of the audio signal;

the plurality of subband signals comprises a plurality of lowband signals indicative of the lowband signal;

the audio encoder comprises a compression unit configured to compress the plurality of lowband signals using a compression function, to provide a plurality of compressed lowband signals;

the waveform data is indicative of the plurality of compressed lowband signals; and the metadata is indicative of the compression function used by the compression unit.

EEE32. The audio encoder of EEE31, wherein the metadata indicative of the spectral envelope of the highband signal is applicable to the same portion of the audio signal as the metadata indicative of the compression function.

EEE33. A data stream comprising a sequence of access units for a sequence of frames of an audio signal, respectively; wherein an access unit from the sequence of access units comprises waveform data and metadata; wherein the waveform data and the metadata are associated with the same particular frame of the sequence of frames of the audio signal; wherein the waveform data and the metadata are indicative of a reconstructed version of the particular frame.

EEE34. The data stream of EEE 33, wherein the particular frame of the audio signal comprises a lowband signal and a highband signal; wherein the waveform data is indicative of the lowband signal; and wherein the metadata is indicative of a spectral envelope of the highband signal.

EEE35. The data stream of any of EEEs 33 to 34, wherein the metadata is indicative of a compression function applied to the lowband signal.

EEE36. A method for determining a reconstructed frame of an audio signal from an access unit of a received data stream; wherein the access unit comprises waveform data and metadata; wherein the waveform data and the metadata are associated with the same reconstructed frame of the audio signal; wherein the method comprises generating a plurality of waveform subband signals from the waveform data;

generating decoded metadata from the metadata;

time-aligning the plurality of waveform subband signals and the decoded metadata; and generating the reconstructed frame of the audio signal from the time-aligned plurality of waveform subband signals and decoded metadata.

EEE37. A method for encoding a frame of an audio signal into an access unit of a data stream; wherein the access unit comprises waveform data and metadata; wherein the waveform data and the metadata are indicative of a reconstructed frame of the frame of the audio signal; wherein the method comprises generating the waveform data from the frame of the audio signal;

generating the metadata from the frame of the audio signal; and time-aligning the waveform data and the metadata such that the access unit for the frame of the audio signal comprises the waveform data and the metadata for the same frame of the audio signal.

The invention claimed is:

1. An audio decoder comprising:

a waveform processing path configured to generate at least a waveform signal from waveform data obtained from an access unit of a data stream of an audio signal;

a metadata processing path configured to generate decoded metadata from metadata obtained from the access unit, the metadata processing path comprising a metadata delay unit configured to delay the decoded metadata by a delay N, wherein N is greater than zero and the N delay is greater than or equal to a delay introduced by the waveform processing path; and a metadata application and synthesis unit configured to generate a reconstructed frame of the audio signal from the at least a waveform signal and from the decoded metadata, wherein at least one of the waveform processing path or the metadata processing path comprises at least one delay unit configured to time-align the at least a waveform signal and the decoded metadata.

2. The audio decoder of claim 1, wherein a fixed delay is introduced by an analysis unit that corresponds to 320 samples of the audio signal.

3. The audio decoder of claim 1, wherein an overall delay of the waveform processing path depends on one of: an encoded bitstream signal or a pre-determined lookahead between metadata and waveform data.

4. The audio decoder of claim 1, wherein the at least a waveform signal and the decoded metadata are time-aligned, such that an overall delay of the waveform processing path corresponds to an overall delay of metadata processing path.

5. The audio decoder of claim 1, wherein the at least a waveform signal and the decoded metadata are time-aligned, such that the at least a waveform signal and the decoded metadata are provided to the metadata application and synthesis unit just-in-time for the processing performed by the metadata application and synthesis unit.

6. A method comprising:

generating, using a waveform processing path, at least a waveform signal from waveform data from the waveform data;

generating, using a metadata processing path, decoded data from metadata obtained from an access unit of a data stream of an audio signal, the metadata processing path comprising a metadata delay unit configured to delay the decoded metadata by a delay N, wherein N is greater than zero and the N delay is greater than a delay introduced by the waveform processing path; and generating using a metadata application and synthesis unit, a reconstructed frame of the audio signal from the at least a waveform signal and from the decoded metadata, wherein at least one of the waveform processing path or the metadata processing path comprises at least one delay unit configured to time-align the at least a waveform signal and the decoded metadata.

7. A non-transitory storage medium adapted for execution on a processor and for performing the method of claim 6 when carried out on the processor.

8. The method of claim 6, wherein the at least a waveform signal and the decoded metadata are time-aligned, such that an overall delay of the waveform processing path corresponds to an overall delay of metadata processing path.

9. The method of claim 6, wherein the at least a waveform signal and the decoded metadata are time-aligned, such that the at least a waveform signal and the decoded metadata are provided to the metadata application and synthesis unit just-in-time for the processing performed by the metadata application and synthesis unit.

* * * * *